United States Patent [19]

Cable

[11] Patent Number: 4,919,627

[45] Date of Patent: Apr. 24, 1990

[54] ELECTRICAL CONNECTOR

[75] Inventor: Neil Cable, Leiden, Netherlands

[73] Assignee: Agence Spatiale Europeenne, Paris, France

[21] Appl. No.: 272,668

[22] Filed: Nov. 17, 1988

[30] Foreign Application Priority Data

Dec. 2, 1987 [FR] France ..... 8716706

[51] Int. Cl.[5] ..... H01R 13/627

[52] U.S. Cl. ..... 439/263; 439/180; 439/372

[58] Field of Search ..... 439/261, 263, 265, 180, 439/372, 819, 821, 823, 258, 259, 152, 153, 157; 403/325, 330

[56] References Cited

U.S. PATENT DOCUMENTS 4,118,094 10/1978 Key ..... 439/635

4,591,222 5/1986 Shaffer ..... 439/265

*Primary Examiner*—Steven C. Bishop

*Attorney, Agent, or Firm*—Bell, Seltzer, Park & Gibson

[57] ABSTRACT

The present invention relates to an electrical connector comprising first and second insulating supports (10, 20) respectively provided with first and second terminals (11, 22). The first terminals (11) are moving terminals and the connector includes actuator means (30) for causing said moving terminals to move between a first position (I) in which the moving terminals (11) are held in intimate engagement with the second terminals (22) which are fixed, and a second position (II) in which the moving terminals (11) are held radially away from and fully disengaged from the fixed terminals, with said actuator means (30) responding to the application of axial force to move said moving terminals. This makes it possible to disassemble and to assemble the two supports without having to overcome any friction between the fixed and moving terminals. The invention is applicable to the electrical industry, and in particular to providing equipment for use in manned spacecraft.

4 Claims, 2 Drawing Sheets

ELECTRICAL CONNECTOR

The present invention relates to an electrical connector of the type having circular symmetry, and it is intended particularly, but not exclusively, for use on-board manned spacecrafts.

BACKGROUND OF THE INVENTION

Although the operations of assembling and disassembling an electrical connector do not normally present special difficulties, the need is felt on-board manned spacecrafts to reduce the forces required to perform these operations to beneath certain critical values because the space environment imposes bulky equipment on astronauts, limiting their freedom of movement and thus the forces they can apply, and this applies both to operations performed manually and to operations performed using tools.

The design of prior art circularly symmetrical connectors for use on the ground, i.e. under normal conditions, is such that the forces required for connecting or disconnecting such connectors are high compared with the values which would be desirable for space applications. This is due to the fact that it is necessary to overcome the friction forces between the terminals via which electrical contact is established, which forces arise during assembly or disassembly of a connector from the very beginnings of such assembly or disassembly.

Connectors of the type having a so-called "linear" structure have already been made in which cams are used for moving the electrical terminals apart while the connector is being assembled or disassembled, thereby reducing the force required for assembly or disassembly. However, in such cases it is necessary to apply two independent actions, and as a result such connectors do not lend themselves to space applications. Further, in such linear connectors, contact is ensured by the elastic properties of the electrical terminals, thereby considerably reducing the contact forces employed, and thus reducing the reliability of the contacts established. In any event, a satisfactory and reliable solution has yet to be proposed for connectors having circular symmetry.

The object of the present invention is thus to provide a connector of the type said to have circular symmetry (about a longitudinal axis, and thus, in fact, having cylindrical symmetry), suitable for satisfying practical requirements better than prior art connectors, in particular with respect to enabling connection and disconnection operations to be performed by applying relatively low forces.

SUMMARY OF THE INVENTION

This object is achieved firstly by assembling the connector portions by moving them axially towards each other prior to any engagement taking place between the electrical terminals, and secondly by disassembling the connector by axially separating its portions only after the terminals have been completely disengaged.

In addition, a connector in accordance with the invention has the following advantages:

the required forces are applied along a single direction which is defined by the longitudinal axis of the connector; and its structure is very simple, including only a small number of component parts, thereby improving reliability and reducing manufacturing costs.

More specifically, the present invention provides an electrical connector having circular symmetry about a longitudinal axis, comprising first and second insulating supports each equipped with at least two terminals, said first support having first terminals and said second support having second terminals, said terminals being connected to electrical conductors, said first and second insulating supports being intended to be assembled and disassembled by being moved axially towards each other and away from each other in order respectively to make and to break electrical contacts between corresponding first and second terminals by mutual engagement or disengagement thereof, said connector including the improvements whereby said first terminals are movable relative to said first support while said second terminals are fixed relative to said second support, and whereby said connector includes actuator means responsive to the application of an axial force to cause said moving terminals to move:

in response to an axial force in a first direction, from a first position in which both insulating supports are axially aligned and are assembled to each other, with the moving terminals being held intimately engaged with said second terminals, to a second position in which both supports are still assembled to each other while the moving terminals are moved radially to completely disengage from the fixed terminals; and vice versa, from said second position to said first position, on application of an axial force in a second direction opposite to said first direction;

thereby enabling the two supports, when axially aligned, to be disassembled by being moved axially away from each other and to be assembled by being moved axially towards each other without any friction forces being generated between said moving terminals and said fixed terminals during the axial disassembly and assembly movements, which movements take place while said moving terminals and fixed terminals are fully disengaged.

In an advantageous embodiment of a connector in accordance with the invention, the moving terminals project axially outwardly relative to said first support and are mounted thereon to pivot about respective axes perpendicular to the longitudinal axis of the support and also perpendicular to the axial planes of symmetry of the moving terminals, and said actuator means for actuating said moving terminals are constituted by a ring which is coaxial with said first support and which presses against the radially outer surfaces of the moving terminals via pressure ribs provided on the radially inner surface of the ring, said ring holding said moving terminals in said first and second positions respectively by applying pressure thereto, and being intended to slide by force over the surfaces of the moving terminals under the effect of said axial forces in such a manner as to pivot said terminals from said first position to said second position, and vice versa, with said pivoting taking place while said first and second supports are axially aligned and engaged, i.e. prior to them being disassembled and after they have been assembled, as the case may be, thereby enabling said supports to be moved axially away from and towards each other without friction.

In another advantageous embodiment of a connector in accordance with the invention, the moving terminals are held by said actuator ring in said first and second positions also by means of a spring which is compressed between said first support and an inwardly directed annular shoulder on the actuator ring, and by means of first and second radial abutments against which said annular shoulder of the actuator ring comes respectively into abutment when in its positions which correspond to said first and second positions of the moving terminals.

In an advantageous disposition of this embodiment, the first radial abutment is constituted by a projection provided at one end of a peg around which said spring is disposed, said peg projecting axially from the first support for supporting the moving terminals, and the second abutment is constituted by a locking device which is put into action once the moving terminals are engaged in the fixed terminals.

A connector in accordance with the invention may naturally include dispositions other than those specified above, as can be seen from the following description.

BRIEF DESCRIPTION OF THE DRAWINGS

An embodiment of the invention is described by way of example with reference to the accompanying drawings, in which.

MORE DETAILED DESCRIPTION

Figure 1:
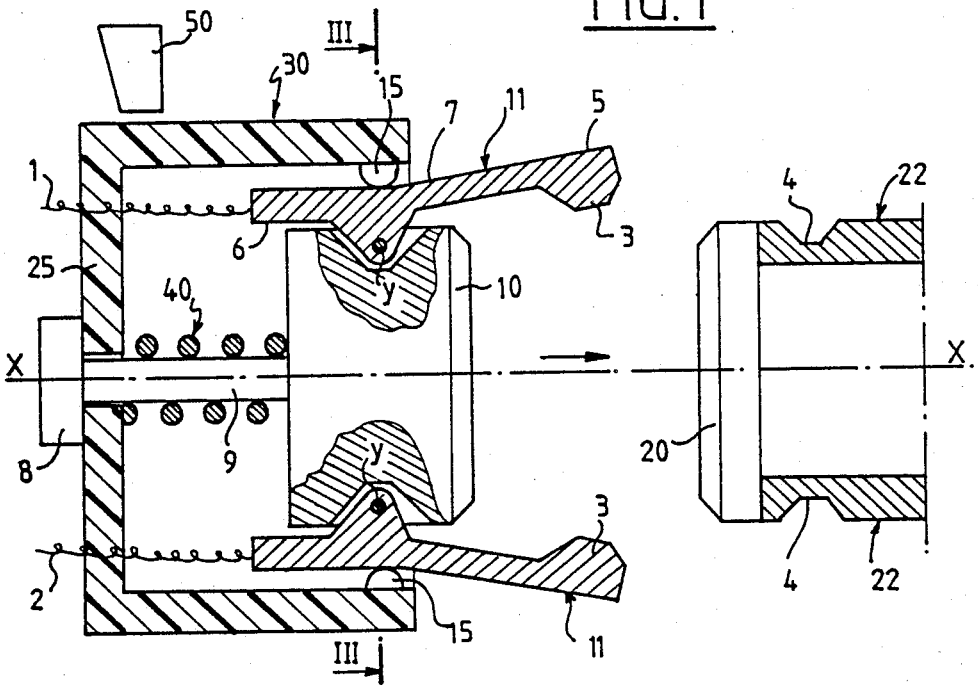
FIG. 1 is a diagrammatic axial section through an electrical connector in accordance with the invention prior to the connector portions being assembled to each other.
Figure 2:
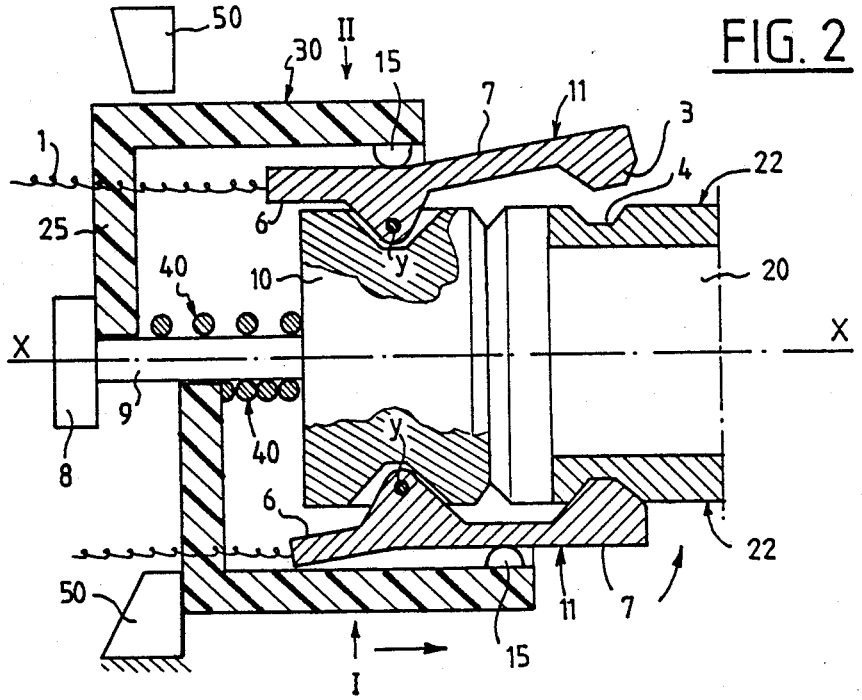
FIG. 2 comprises two axial half-sections situated on either side of the longitudinal axis of the connector, with the top half-section showing the assembly stage during which the insulating supports of the fixed and moving electrical terminals of the connector are moved axially towards each other without said terminals engaging one another, while the bottom half-section shows the following stage in which intimate engagement takes place between said terminals.

The electrical connector shown in FIGS. 1 and 2 is a connector of the type having circular symmetry about a longitudinal axis X (i.e., more precisely having cylindrical symmetry) comprising a first cylindrical insulating support fitted with moving electrical terminals 11 connected to two electrical conductors 1 and 2, and a second cylindrical insulating support 20 fitted with fixed electrical terminals 22 (with the support 20 being shown partially cut-away and with the electrical conductors connecting the terminals 22 to an electrical circuit being omitted from the figures).

The fixed terminals 22 are disposed on either side of the longitudinal axis X and run axially along the second support 20.

The moving terminals 11 are also disposed so as to run substantially axially, however they are also capable of pivoting about respective axes Y perpendicular to the axis X so as to move radially towards each other and away from each other.

When the terminals 11 are moved radially apart, the supports 10 and 20 can be assembled by moving them axially towards each other without any contact taking place between the terminals 11 and 22 throughout the entire axial assembly movement (or axial stroke, see FIG. 1 and the top half-section of FIG. 2).

The moving terminals 11 are brought into intimate engagement with the fixed terminals 22 by being moved towards each other radially causing radially inwardly directed protections 3 on the terminals 11 to penetrate into radial notches 4 in the terminals 22 (see bottom half-section of FIG. 2).

Actuator means for actuating the moving terminals 11 serve to move the moving terminals 11 from a position I, in which they are radially closer together and thus engaged with the fixed terminals 22, to a position II in which they are radially further apart and thus completely disengaged from the terminals 22, assuming that the supports 10 and 20 are in axial engagement (see top and bottom halves of FIG. 2).

Said actuator means are constituted by a ring 30 which is force-fitted (by applying pressure) around the moving terminals 11 and which is capable of sliding along the radially outer surfaces 5 of the terminals from one side to the other of the pivot axis Y of each moving terminal 11, when an axial force is applied to the ring.

The pressure clamping of the moving terminals is made more effective by means of radial pressure ribs 15 provided on the radially inside surface of the ring 30 (naturally, if the ring is made of metal, then the ribs 15 must be made of insulating material in order to avoid short circuits).

When the ring 30 is in the position shown in the bottom half-section of FIG. 2, i.e. to the right of the axes Y, then the clamping pressure exerted by the ring on the terminals 11 causes them to pivot radially inwardly by a lever action, and holds them in this position in engagement with the fixed terminals 22.

When the ring 30 is displaced axially towards the position shown in the top half-section of FIG. 2, the above-mentioned lever action reduces as the pressure rib 15 of the ring 30 moves along the axis X until it comes level with the axes Y, until there is no lever effect when the rib 15 is radially aligned with the axes Y, after which the lever effect is reversed as the rib continues beyond the axes Y.

In FIG. 1, and in the top half-section of FIG. 2, it can be seen that, for reasons of security, the moving terminals 11 have already moved far enough apart radially to disengage completely from the fixed terminals 22 by the time the pressure ribs 15 are radially aligned with the pivot axes Y of the moving terminals, i.e. once the lever effect exerted by the ring 30 about each of the axes Y has reduced to zero (i.e. when no pivot action is exerted on the moving terminals). This means that the moving terminals 11 are not parallel to the longitudinal axis X, but have a portion 7 which is already flared radially outwardly by an amount which is sufficient to ensure that no contact is made with the fixed terminals 22. Said portion 7 is followed by a portion 6 which, in this position, extends axially. Thus, the moving terminals 11 are not rectilinear in axial section but are in the form of a bent line having successive portions 6 and 7.

The ring 30 is held in its position for which the moving terminals 11 are radially distant from the fixed terminals 22 (see top half-section of FIG. 2) by virtue of the clamping action of the ring as provided via the pressure ribs 15.

This position may be held more reliably by making the actuator ring co-operate with a spring 40 which is compressed between the first support 10, on which the moving terminals 11 are mounted, and an inwardly directed annular shoulder 25 of the ring 30, said shoulder coming into abutment against a head 8 on the end of an axial peg 9 projecting from the cylindrical support 10 and supporting said spring 40.

Similarly, the reliability with which the ring 30 is held in its position in which the moving terminals 11 are intimately engaged with the fixed terminals 22 (see bottom half-section of FIG. 2) can be improved by co-operation between the ring with the above-specified spring 40 and another radial abutment constituted by a locking device 50 which is put into action after the moving terminals 11 have engaged the fixed terminals 22.

The use of such a locking device is essential when the connector is used in a dynamic environment in order to ensure that vibration cannot shake the connector loose.

Naturally, if the connector of the invention is to be used for space applications, then the materials that can be used and the lubricants which may be required must be compatible with the requirements imposed by space technology.

Further, in order to avoid problems related to mechanical forces due to temperature changes, the materials constituting parts which co-operate with one another must have temperature expansion coefficients which are suitably close together.

It is clear from the above description that a connector in accordance with the invention satisfies the objects of the invention, in particular that the force required for connecting and disconnecting its electrical terminals is low by virtue of any frictional contact between the electrical terminals being avoided other than when they are fully engaged with each other.

Further, the connection and disconnection operations can be performed by applying forces solely along the axial direction of the connector.

As can be seen from the above, the invention is not limited to the embodiment and the application which have been described in greater detail; on the contrary, it extends to any variant that may occur to the person skilled in the art without going beyond the scope of the claims. In particular, it should be observed that when the electrical terminals are in the engaged position, i.e. when electrical contact is established, they may be protected in conventional manner by means of an additional ring (not shown, but similar to the ring 30) which is coaxial to the second support for the fixed terminals and which is fixed to the ring for actuating the moving terminals, e.g. by being screwed thereto.

Figure 3:
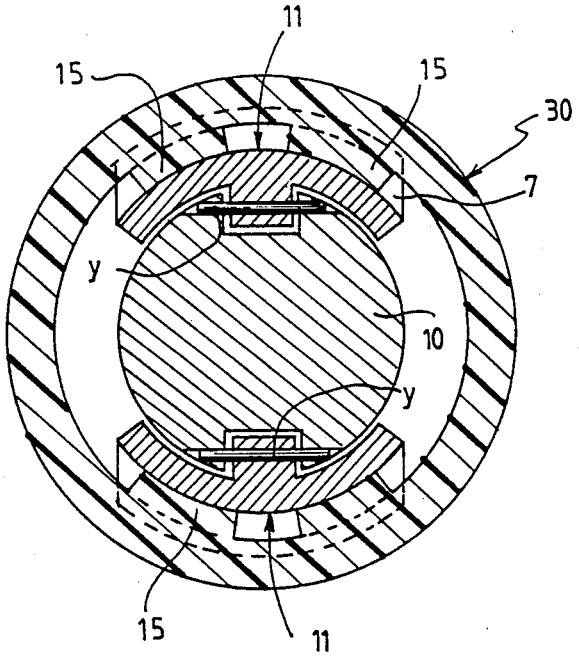
FIG. 3 is a cross-section on plane III of FIG. 1 showing the disposition of the moving terminals 11 about the insulating support 10.

Further, it should naturally be understood that the drawings and the corresponding description are given purely by way of illustration of one particular embodiment of the invention, and they must not be considered as limiting the scope of the invention. In particular, although the connector shown has only two moving terminals and two fixed terminals, it is clear that the solution provided by the present invention to the above-mentioned technical problem is equally applicable to connectors having multiple terminals, e.g. comprising several pairs of moving terminals and a corresponding number of pairs of fixed terminals disposed around corresponding supports and appropriately spaced. Further, the disposition of the moving terminals as shown diagrammatically in FIG. 3 is not limiting and other equivalent solutions may be envisaged. The fixed terminals naturally have a corresponding configuration.

In any event, when the number of terminals makes it possible, the extended arcuate configuration of the terminals (as opposed to a merely rectilinear and narrow configuration) is particularly advantageous for ensuring that contact takes place independently of position.

I claim:

1. An electrical connector having circular symmetry about a longitudinal axis, comprising first and second insulating supports each equipped with at least two terminals, said first support having first terminals and said second support having second terminals, said terminals being connected to electrical conductors, said first and second insulating supports being intended to be assembled and disassembled by being moved axially towards each other and away from each other in order respectively to make and to break electrical contacts between corresponding first and second terminals by mutual engagement or disengagement thereof, said connector including the improvements whereby said first terminals are mounted for pivoting movement relative to said first support while said second terminals are fixed relative to said second support, and whereby said connector includes actuator means responsive to the application of an axial force to cause said first terminals to pivotally move:

in response to an axial force in a first direction, from a first position in which both insulating supports are axially aligned and are assembled to each other, with the first terminals being held intimately engaged with said second terminals, to a second position in which both supports are still assembled to each other while the first terminals are pivoted away from said second terminals to completely disengage from the fixed terminals; and vice versa, from said second position to said first position, on application of an axial force in a second direction opposite to said first direction;

thereby enabling the two supports, when axially aligned, to be disassembled by being moved axially away from each other and to be assembled by being moved axially towards each other without any friction forces being generated between said first terminals and said second terminals during the axial disassembly and assembly movements, which movements take place while said first terminals and second terminals are fully disengaged.

2. An electrical connector having circular symmetry about a longitudinal axis, comprising first and second insulating supports each equipped with at least two terminals, said first support having first terminals and said second support having second terminals, said terminals being connected to electrical conductors, said first and second insulating supports being intended to be assembled and disassembled by being moved axially towards each other and away from each other in order respectively to make and to break electrical contacts between corresponding first and second terminals by mutual engagement or disengagement thereof, said connector including the improvements whereby said first terminals are movable relative to said first support while said second terminals are fixed relative to said second support, and whereby said connector includes actuator means responsive to the application of an axial force to cause said moving terminals to move:

in response to an axial force in a first direction, from a first position in which both insulating supports are axially aligned and are assembled to each other, with the moving terminals being held intimately engaged with said second terminals, to a second position in which both supports are still assembled to each other while the moving terminals are moved radially to completely disengage from the fixed terminals; and vice versa, from said second position to said first position, on application of an axial force in a second direction opposite to said first direction;

wherein the moving terminals project axially outwardly relative to said first support and are mounted thereon to pivot about respective axes perpendicular to the longitudinal axis of the support and also perpendicular to the axial planes of symmetry of the moving terminals, and wherein said actuator means for actuating said moving terminals are constituted by a ring which is coaxial with said first support and which presses against the radially outer surfaces of the moving terminals via pressure ribs provided on a radially inner surface of the ring, said ring holding said moving terminals in said first and second positions respectively by applying pressure thereto, and being intended to slide by force over the surfaces of the moving terminals under the effect of said axial forces in such a manner as to pivot said terminals from said first position to said second position, and vice versa, with said pivoting taking place while said first and second supports are axially aligned and engaged, i.e. prior to them being disassembled and after they have been assembled, as the case may be, thereby enabling the two supports, when axially aligned, to be disassembled by being moved axially away from each other and to be assembled by being moved axially towards each other without any friction forces being generated between said moving terminals and said fixed terminals during the axial disassembly and assembly movements, which movements take place while said moving terminals and fixed terminals are fully disengaged.

3. A connector according to claim 2, in which the moving terminals are held by said actuator ring in said first and second positions also by means of a spring which is compressed between said first support and an inwardly directed annular shoulder on the actuator ring, and also by means of first and second radial abutments against which said annular shoulder of the actuator ring comes respectively into abutment when in its positions which correspond to said first and second positions of the moving terminals.

4. A connector according to claim 3, wherein said spring is disposed around a peg which projects axially from said first support, and wherein said first radial abutment is constituted by a projection provided at one end of said peg, whereas the second abutment is constituted by a locking device which is put into action once the moving terminals are engaged in the fixed terminals.

* * * * *

UNITED STATES PATENT AND TRADEMARK OFFICE

CERTIFICATE OF CORRECTION

PATENT NO. : 4,919,627

DATED : April 24, 1990

INVENTOR(S) : Neil Cable

It is certified that error appears in the above-identified patent and that said Letters Patent is hereby corrected as shown below:

On the face of the patent under the section "References Cited", the following foreign patents should be listed:

-- 2,535,915 5/11/84 France --
-- 2,535,122 4/27/84 France --

Signed and Sealed this

Twenty-seventh Day of August, 1991

*Attest:*

HARRY F. MANBECK, JR.

*Attesting Officer*

*Commissioner of Patents and Trademarks*